US010597756B2

(12) United States Patent
Weimer et al.

(10) Patent No.: US 10,597,756 B2
(45) Date of Patent: Mar. 24, 2020

(54) TITANIUM ALUMINIDE INTERMETALLIC COMPOSITIONS

(75) Inventors: Michael James Weimer, Loveland, OH (US); Bernard Patrick Bewlay, Niskayuna, NY (US); Michael Francis Xavier Gigliotti, Jr., Glenville, KY (US); Thomas Joseph Kelly, South Lebanon, OH (US)

(73) Assignee: General Electric Company, Schenectady, NY (US)

( * ) Notice: Subject to any disclaimer, the term of this patent is extended or adjusted under 35 U.S.C. 154(b) by 892 days.

(21) Appl. No.: 13/444,357

(22) Filed: Apr. 11, 2012

(65) Prior Publication Data

US 2013/0251537 A1 Sep. 26, 2013

Related U.S. Application Data

(60) Provisional application No. 61/615,253, filed on Mar. 24, 2012.

(51) Int. Cl.

| | |
|---|---|
| ***C22C 14/00*** | (2006.01) |
| ***C22C 1/02*** | (2006.01) |
| ***C22F 1/18*** | (2006.01) |
| ***C22C 1/00*** | (2006.01) |
| ***C22C 21/00*** | (2006.01) |

(52) U.S. Cl.

CPC ..... *C22C 14/00* (2013.01); *C22C 1/00* (2013.01); *C22C 1/02* (2013.01); *C22C 1/026* (2013.01); *C22C 21/00* (2013.01); *C22F 1/183* (2013.01)

(58) Field of Classification Search

CPC ..... C22C 14/00; C22C 1/00; C22C 21/00

USPC ..... 420/418

See application file for complete search history.

(56) References Cited

U.S. PATENT DOCUMENTS

| | | | | |
|---|---|---|---|---|
| 3,203,794 | A | 8/1965 | Jaffee et al. | |
| 4,294,615 | A | 10/1981 | Blackburn et al. | |
| 4,661,316 | A | 4/1987 | Hashimoto et al. | |
| 4,703,806 | A | 11/1987 | Lassow et al. | |
| 4,740,246 | A | 4/1988 | Feagin | |
| 4,787,439 | A | 11/1988 | Feagin | |
| 4,842,819 | A | 6/1989 | Huang et al. | |
| 4,879,092 | A | 11/1989 | Huang | |
| 4,916,028 | A * | 4/1990 | Huang | 428/614 |
| 4,947,927 | A | 8/1990 | Horton | |

(Continued)

FOREIGN PATENT DOCUMENTS

| | | |
|---|---|---|
| CN | 1962179 A | 5/2007 |
| CN | 101457314 A | 6/2009 |

(Continued)

OTHER PUBLICATIONS

Machnie translation of JP06299276A, 10,1994.*

(Continued)

*Primary Examiner* — Jie Yang

(74) *Attorney, Agent, or Firm* — Dority & Manning, P.A.

(57) ABSTRACT

Gamma titanium aluminide intermetallic compositions (gamma TiAl intermetallics) based on the TiAl (gamma) intermetallic compound. The gamma TiAl intermetallics contain chromium and niobium, as well as controlled amounts of carbon that achieve a desirable balance in room temperature mechanical properties and high temperature creep capabilities at temperatures approaching and possibly exceeding 1600° F. (about 870° C.).

3 Claims, 2 Drawing Sheets

(56) References Cited

U.S. PATENT DOCUMENTS

| | | | | |
|---|---|---|---|---|
| 4,996,175 | A | 2/1991 | Sturgis | |
| 5,196,162 | A | 3/1993 | Maki et al. | |
| 5,221,336 | A | 6/1993 | Horton | |
| 5,284,620 | A | 2/1994 | Larsen, Jr. | |
| 5,350,466 | A | 9/1994 | Larsen, Jr. et al. | |
| 5,354,351 | A | 10/1994 | Kampe et al. | |
| 5,370,839 | A * | 12/1994 | Masahashi et al. | 420/418 |
| 5,393,356 | A | 2/1995 | Singheiser | |
| 5,407,001 | A | 4/1995 | Yasrebi et al. | |
| 5,429,796 | A | 7/1995 | Larsen, Jr. | |
| 5,464,797 | A | 11/1995 | Yasrebi et al. | |
| 5,545,265 | A | 8/1996 | Austin et al. | |
| 5,609,698 | A | 3/1997 | Kelly et al. | |
| 5,624,604 | A | 4/1997 | Yasrebi et al. | |
| 5,634,992 | A | 6/1997 | Kelly et al. | |
| 5,766,329 | A | 6/1998 | LaSalle et al. | |
| 5,785,775 | A | 7/1998 | Smashey et al. | |
| 5,823,243 | A | 10/1998 | Kelly | |
| 5,839,504 | A | 11/1998 | Matsuda | |
| 5,873,703 | A | 2/1999 | Kelly et al. | |
| 5,997,808 | A | 12/1999 | Jones et al. | |
| 6,231,699 | B1 | 5/2001 | Kelly et al. | |
| 7,360,579 | B2 | 4/2008 | Renkel et al. | |
| 7,389,808 | B2 | 6/2008 | Renkel et al. | |
| 7,389,809 | B2 | 6/2008 | Renkel et al. | |
| 7,527,477 | B2 | 5/2009 | Norton et al. | |
| 7,582,133 | B2 | 9/2009 | Kelly et al. | |
| 7,704,339 | B2 | 4/2010 | Voice et al. | |
| 7,761,969 | B2 | 7/2010 | Bewlay et al. | |
| 7,790,101 | B2 | 9/2010 | Kelly et al. | |
| 7,923,127 | B2 | 4/2011 | Das | |
| 8,007,712 | B2 | 8/2011 | Bewlay et al. | |
| 8,048,365 | B2 | 11/2011 | Bewlay et al. | |
| 8,062,581 | B2 | 11/2011 | Bewlay et al. | |
| 8,136,572 | B2 * | 3/2012 | Renkel | 164/114 |
| 8,579,013 | B2 | 11/2013 | Bewlay et al. | |
| 9,186,719 | B2 | 11/2015 | Bewlay et al. | |
| 2006/0138200 | A1 * | 6/2006 | Oehring | B32B 15/01 228/178 |
| 2006/0280610 | A1 | 12/2006 | Heyward et al. | |
| 2008/0066288 | A1 | 3/2008 | Patrick et al. | |
| 2009/0097979 | A1 | 4/2009 | Erdmann et al. | |
| 2009/0133850 | A1 | 5/2009 | Kelly et al. | |
| 2009/0151822 | A1 | 6/2009 | Appel et al. | |
| 2011/0094705 | A1 | 4/2011 | Kelly et al. | |
| 2012/0294368 | A1 | 11/2012 | Kondo | |
| 2013/0248061 | A1 | 9/2013 | Kelly et al. | |

FOREIGN PATENT DOCUMENTS

| | | | |
|---|---|---|---|
| CN | 101476061 | A | 7/2009 |
| CN | 102668568 | A | 9/2012 |
| EP | 0521516 | A1 | 1/1993 |
| EP | 1052298 | A1 | 11/2000 |
| JP | 03257130 | A | 11/1991 |
| JP | 04107233 | A | 4/1992 |
| JP | 05186842 | A | 7/1993 |
| JP | 06299276 | A * | 10/1994 |
| JP | 06346173 | A | 12/1994 |
| JP | 2008184665 | A | 8/2008 |
| KR | 20110117397 | A | 10/2011 |

OTHER PUBLICATIONS

Search Report and Written Opinion from EP Application No. 13160474.6 dated Oct. 1, 2013.

Chinese Office Action and Search Report issued in connection with corresponding CN Application No. 201310094715.3 dated Dec. 3, 2015.

B.D. Worth, J.W. Jones, J.E. Allison: Metallurgical and Materials Transactions A, 26A, p. 2961 (1995).

A. Menamd, A. Huguet, A. Nérac-Partaix: Acta Materialia, 44, p. 4279 (1996).

M. Maruyama, R. Yamamoto, H. Nakakuki, N. Fujitsuna: Materials Science and Engineering A, 239-240, p. 419 (1997).

W.H. Tian, M. Nemoto: Intermetallics, 5, p. 237 (1997).

C.E. Wen, K. Yasue, J.G. Lin, Y.G. Zhang, C.O. Chen: Intermetallics, 8, p. 525 (2000).

F. Perdrix, M.F. Trichet, J.L. Bonnentien, M. Cornet, J. Bigot: Intermetallics, 9, p. 807 (2001).

Y. Yamamoto, M. Takeyama, T. Matsuo: Materials Science and Engineering A, 329-331, p. 631 (2002).

F. Appel, J.D.H. Paul, M. Oehring, U. Fröbel, U. Lorenz: Metallurgical and Materials Transactions A, 34A, p. 2149 (2003).

M. Karadge, Y.-W. Kim, P.I. Gouma: Metallurgical and Materials Transactions A, 34A, p. 2129 (2003).

W.J. Zhang, S.C. Deevi: Materials Science and Engineering A, 362, p. 280 (2003).

H.F. Chladil, H. Clemens, H. Leitner, A. Bartels, R. Gerling, F.P. Schimansky, S. Kremmer: Intermetallics, 14, p. 1194 (2006).

M. Karadge, Y.-W. Kim, P.I. Gouma: Applied Physics Letter, 89, 181921 (2006).

C. Scheu, E. Stergar, M. Schober, L. Cha, H. Clemens, B. Bartels, F.P. Schimansky, A. Cerezo: Acta Materialia, 57, p. 1504 (2009).

H. Clemens, W. Smarsly: Advanced Materials Research, 278, p. 551 (2011).

B.P. Bewlay, M. Weimer, T. Kelly, A. Suzuki, P.R. Subramanian: Intermetallic-based Alloys—Science, Technology, and Applications, edited by I. Baker, M. Heilmaier, S. Kumar and K. Yoshimi (MRS Symp. Proc. 1516, Warrendale, PA, 2012), DOI: 10.1557/opl.2013.44.

E. Schwaighofer, B. Rashkova, H. Clemens, A. Stark, S. Mayer: Intermetallics, 46, p. 173 (2014).

M. Kastenhuber, B. Rashkova, H. Clemens, S. Mayer: Intermetallics, 63, p. 19 (2015).

T. Klein, M. Schachermayer, F. Mendez-Martin, T. Schöberl, B. Rashkova, H. Clemens, S. Mayer: Acta Materialia, 94, p. 205 (2015).

Unofficial English Translation of Japanese Office Action issued in connection with corresponding JP Application No. 2013061244 dated Jan. 24, 2017.

Unofficial English Translation of Japanese Search Report issued in connection with corresponding JP Application No. 2013061244 dated Feb. 27, 2017.

* cited by examiner

TITANIUM ALUMINIDE INTERMETALLIC COMPOSITIONS

CROSS REFERENCE TO RELATED APPLICATIONS

This application claims the benefit of U.S. Provisional Application No. 61/615,253, filed Mar. 24, 2012, the contents of which are incorporated herein by reference.

The present invention generally relates to compositions containing titanium and aluminum and the processing thereof. More particularly, this invention relates to titanium aluminide intermetallic compositions (TiAl intermetallics) based on the TiAl (gamma) intermetallic compound, with controlled additions of carbon to enhance creep resistance while maintaining acceptable room temperature ductility.

Because weight and high temperature strength are primary considerations in gas turbine engine design, there is a continuing effort to create relatively light weight compositions that have high strength at elevated temperatures. Titanium-based alloy systems are well known in the art as having mechanical properties that are suitable for relatively high temperature applications. High temperature capabilities of titanium-based alloys have increased through the use of titanium intermetallic systems based on the titanium aluminide compounds $Ti_3Al$ (alpha-2 ($\alpha$-2)) and TiAl (gamma ($\gamma$)). These titanium aluminide intermetallic compounds (or, for convenience, TiAl intermetallics) are generally characterized as being relatively light weight, yet are known to be capable of exhibiting high strength, creep strength and fatigue resistance at elevated temperatures. However, the production of components from TiAl intermetallics by extrusion, forging, rolling and casting is often complicated by their relatively low ductility.

As taught in U.S. Pat. No. 4,879,092 to Huang, additions of chromium and niobium promote certain properties of gamma TiAl intermetallics, such as oxidation resistance, ductility, strength, etc. Huang discloses a particular titanium aluminide intermetallic composition having an approximate formula of $Ti_{46\text{-}50}Al_{46\text{-}50}Cr_2Nb_2$, or nominally about Ti-48Al-2Cr-2Nb. This alloy, referred to herein as the 48-2-2 alloy, is considered to exhibit desirable environmental resistance, room temperature ductility and damage tolerance that enable its use in gas turbine applications, for example, in the low pressure turbine sections of gas turbine engines and particularly as the material for low pressure turbine blades (LPTB).

Additions of carbon have been proposed for TiAl intermetallics to promote certain properties. For example, U.S. Pat. No. 3,203,794 to Jaffee et al. discloses that carbon can be included in amounts of up to 1 atomic percent (10,000 ppm) in a gamma TiAl alloy that contains 34 to 46 atomic percent aluminum. Another example is U.S. Pat. No. 4,294,615 to Blackburn et al., which discloses the inclusion of carbon in amounts of 0.05 to 0.25 atomic percent (500 to 2500 ppm) in a gamma TiAl alloy that contains 48 to 50 atomic percent aluminum and 0.1 to 3 atomic percent vanadium. U.S. Pat. No. 4,661,316 to Hashimoto et al. discloses a gamma TiAl alloy that contains 30 to 36 weight percent aluminum and 0.1 to 5 weight percent manganese, and may further include in carbon amounts of 0.02 to 0.12 weight percent in the alloy. However, Jaffee et al., Blackburn et al., and Hashimoto et al. generally disclose that carbon additions tend to reduce ductility. On the other hand, U.S. Pat. No. 4,916,028 to Huang discloses that carbon additions of 0.05 to 0.3 atomic percent (500 to 3000 ppm) can improve ductility in rapidly solidified and extruded components produced from a gamma TiAl alloy that is based on the 48-2-2 alloy and contains 46 to 50 atomic percent aluminum, 1 to 3 atomic percent chromium, and 1 to 5 atomic percent niobium. Notably, Blackburn et al. taught that carbon concentrations in the range of 0.05 to 0.25 atom % (0.02 to 0.12% weight), and preferred in the amount of 0.1 to 0.2 atom % (0.05% to 0.1% weight), have advantages in Ti—Al—V alloys of improving high temperature properties, but with some reduction of room temperature ductility. Blackburn et al. did not teach the use of carbon at levels below 500 ppm in chromium and niobium containing alloys. Accordingly there is a need to increase creep performance and maintain a minimum level of ductility and fatigue crack growth resistance in niobium- and chromium-containing TiAl alloys.

The 48-2-2 alloy has a nominal temperature capability of up to about 1400° F. (about 760° C.), with useful but diminishing capabilities up to about 1500° F. (about 815° C.). However, more expansive use of this alloy within the low pressure turbine and elsewhere could be possible if improved creep resistance could be achieved at temperatures exceeding 1500° F. (about 815° C.), for example, to temperatures of about 1600° F. (about 870° C.). Accordingly, there is a desire to expand the creep capability of the 48-2-2 alloy, though without sacrificing the environmental resistance, room temperature ductility and damage tolerance of this alloy system. An acceptable level of creep resistance for LPTB applications, a nominal ductility of 1%, and a minimum ductility of 0.5% are believed to be desired if not necessary in order to provide adequate design margin as well as the ability to cast and machine components with complex shapes from the alloy. Notably, while improved creep resistance has been demonstrated in gamma TiAl intermetallic compositions through additions of high levels of refractory elements such as niobium and with carbon contents of typically 1000 ppm or more, with the exception of U.S. Pat. No. 4,916,028, carbon additions at these levels have been associated with reductions in ductility, often resulting in a nominal ductility of 0.1% or less.

BRIEF DESCRIPTION OF THE INVENTION

The present invention provides gamma titanium aluminide intermetallic compositions (gamma TiAl intermetallics) based on the TiAl (gamma) intermetallic compound. The gamma TiAl intermetallics contain chromium and niobium, as well as controlled amounts of carbon that achieve a desirable balance in room temperature mechanical properties and high temperature creep capabilities at temperatures approaching and possibly exceeding 1600° F. (about 870° C.).

The TiAl intermetallic compositions are based on the aforementioned 48-2-2 alloy and contain 46 to 50 atomic percent aluminum, 1 to 3 atomic percent chromium, and 1 to 5 atomic percent niobium, but they further contain carbon that, when included in very controlled amounts of about 160 to 500 ppm (about 0.016 to 0.05 atomic percent), is capable of promoting the creep resistance properties of the composition without unacceptably decreasing its room temperature ductility.

Other aspects and advantages of this invention will be better appreciated from the following detailed description.

DETAILED DESCRIPTION OF THE INVENTION

The present invention provides a gamma TiAl intermetallic composition that contains controlled amounts of chromium, niobium, and carbon to achieve a desirable balance of room temperature mechanical properties and high temperature creep capabilities that render the composition suitable for use in high temperature applications, including but not limited to the low pressure turbine section of a gas turbine engine.

Mechanistically, carbon is known to increase the strength of TiAl intermetallic compositions by serving as an interstitial strengthening agent. According to the present invention, very controlled carbon additions are capable of promoting creep resistance properties without unacceptably decreasing room temperature ductility of gamma TiAl intermetallic compositions that contain 46 to 50 atomic percent aluminum, 1 to 3 atomic percent chromium, 1 to 5 atomic percent niobium. This advantageous balance of properties can be particularly achieved if the carbon level is about 160 to 500 ppm (about 0.016 to 0.05 atomic percent), more particularly about 160 to 470 ppm (about 0.016 to 0.047 atomic percent). The carbon additions can be introduced when preparing a primary or secondary melt, using virgin or revert/recycled materials of the gamma TiAl intermetallic composition.

During investigations leading to the present invention, it was determined that, in gamma TiAl intermetallic compositions containing 1 to 3 atomic percent chromium and 1 to 5 atomic percent niobium, an inverse linear relationship exists between carbon content and room temperature ductility within a narrow carbon content range of 160 to 500 ppm. Concomitantly, the creep resistance of such compositions was observed to improve as the carbon content was increased over this range. On the basis of these relationships, it was further determined that controlled additions of carbon can result in improved creep resistance while maintaining adequate ductility to enable the design and manufacturing of components from such compositions, for example, when cast and processed to produce low pressure turbine blades of gas turbine engines.

Figure 2:
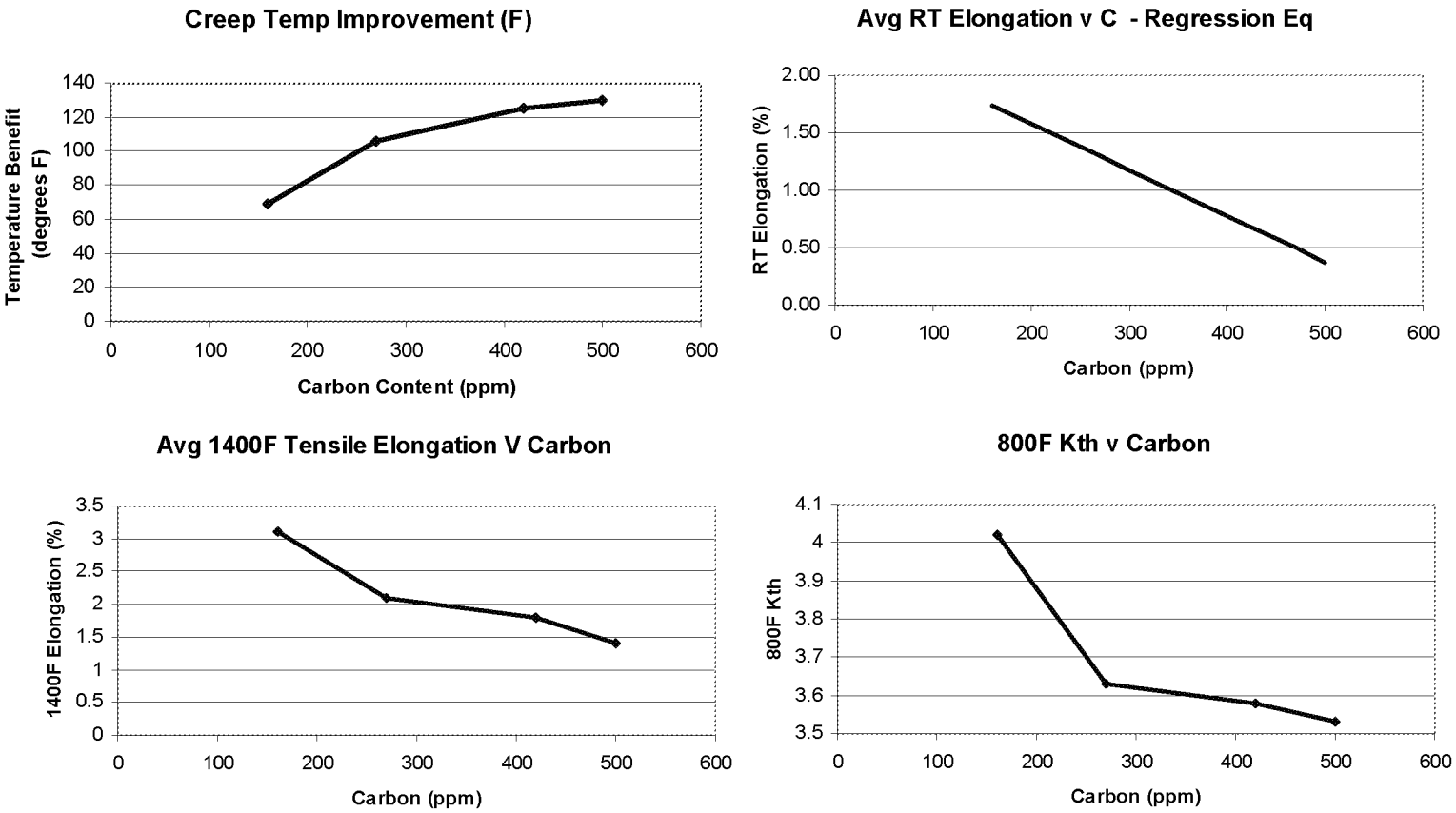
FIG. 2 contains four graphs that plot fatigue creep resistance, room temperature and high temperature elongation, and crack growth threshold (Mc) of four experimental gamma titanium aluminide intermetallic compositions containing varying amounts of carbon between 160 and 500 ppm.

During the investigations, alloys containing four different levels of carbon were prepared: 160, 270, 420 and 500 ppm. The compositions were produced by melting ingots of the aforementioned 48-2-2 alloy in an induction skull melter, adding the controlled amounts of carbon to the melt, and then recasting the melt. Aside from their carbon contents, the nominal chemistries of the TiAl intermetallic compositions were, in atomic percent, about 48% aluminum, about 2% chromium, about 1.9% niobium, and the balance titanium and incidental impurities. Each composition was heat treated, hot isostatically pressed (HIPed), and tested for mechanical properties. The results of these tests are plotted in graphs in FIG. 2. As seen in the creep plot, creep resistance was observed to improve with carbon content, but room temperature and 1400° F. (about 760° C.) elongation decreased with carbon content. The crack growth threshold ($K_{th}$) at 800° F. (about 425° C.) was acceptable at all of the tested carbon levels. The latter property is an important consideration for the gamma TiAl intermetallic composition of this invention, since it is a primary parameter of concern for long-term reliability of LPT blades and other components that are similarly subject to conditions that might promote crack propagation.

Overall, the results of the investigation indicated that carbon contents within the ranges tested should provide a high temperature capability exceeding 1500° F. (about 815° C.), and likely about 1600° F. (about 870° C.) or more. Because a minimum room temperature ductility of 0.5% was determined to be a requirement for LPTB applications, the results from the investigated range further indicated that a preferred maximum carbon content for the gamma TiAl intermetallic composition of this invention is 470 ppm. In particular, the specimen containing a carbon level of 500 ppm was concluded to exhibit insufficient room temperature ductility to enable a gamma TiAl intermetallic composition based on the 48-2-2 alloy to be readily processable as an LPT blade. Because a nominal room temperature ductility of 1.0% was identified as desired for LPTB applications, the results of the investigation indicated that the tested carbon level of 270 ppm (0.027 atomic percent) provided a particularly desirable balance of properties. From this, it is believed that a nominal carbon content of about 300 ppm (0.03 atomic percent) was likely to provide an optimal balance between creep strength and room temperature ductility.

Figure 1:
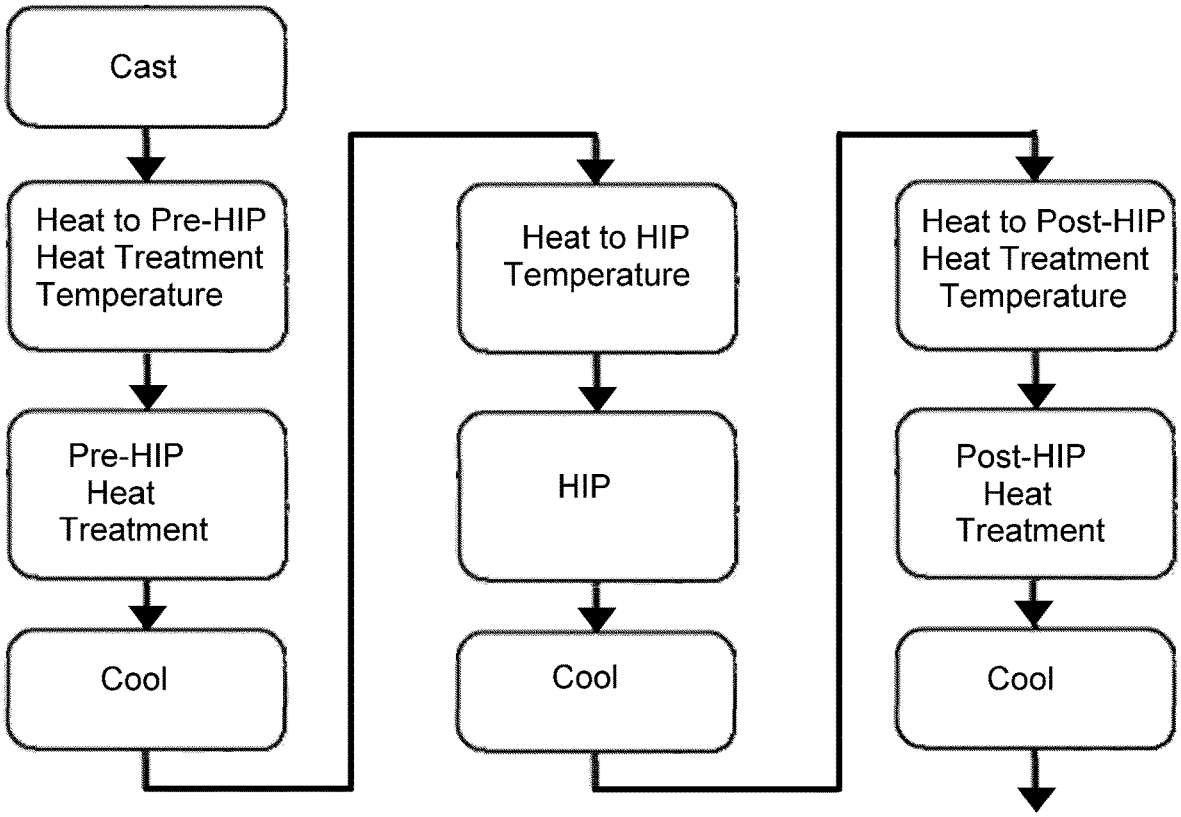
FIG. 1 is a flow chart representing a method of processing castings formed of TiAl intermetallic compositions of this invention.

Gamma TiAl intermetallic compositions of this invention can be processed according to a procedure represented in FIG. 1. As a nonlimiting example, following the production of a casting of the gamma TiAl intermetallic composition, a pre-HIP heat treatment can be performed at a temperature within a range of about 1800 to about 2000° F. (about 980 to about 1090° C.) for a duration of about five to twelve hours. Thereafter, the casting is cooled and transferred to a HIP chamber and then subjected to a high pressure HIP step (for example, 25 ksi (about 1720 bar) or more) at about 2165° F. for a duration of about three hours. The HIPed casting is then cooled, removed from the HIP chamber, and then subjected to a post-HIP solution treatment at a temperature of about 2200° F. for a duration of about two hours. While such a process is believed to be acceptable, a more preferable process is believed to be disclosed in U.S. Patent Application Ser. No. 61/614,751 filed Mar. 23, 2012, whose contents are incorporated herein by reference. The preferred process is particularly adapted to yield castings formed of gamma titanium aluminide intermetallic compositions that exhibit a desirable duplex microstructure containing equiaxed and lamellar morphologies that promote the ductility of the casting.

While the invention has been described in terms of particular embodiments, it is apparent that other forms could be adopted by one skilled in the art. Therefore, the scope of the invention is to be limited only by the following claims.

The invention claimed is:

1. A low pressure turbine blade of gas turbine engine comprising a titanium aluminide intermetallic composition based on a gamma TiAl intermetallic compound, the titanium aluminide intermetallic composition consisting of, by atomic percent, 46 to 50% aluminum, 1 to 3% chromium, 1 to 5% niobium, 160 to 470 ppm carbon, titanium and incidental impurities in amounts to yield the gamma TiAl intermetallic compound, wherein the titanium aluminide intermetallic composition exhibits a minimum room temperature ductility of not lower than 0.5%, and wherein the titanium aluminide intermetallic composition exhibits an average room temperature ductility of at least 1%.

2. The low pressure turbine blade according to claim 1, wherein the titanium aluminide intermetallic composition contains about 300 ppm carbon.

3. The low pressure turbine blade according to claim 1, wherein the titanium aluminide intermetallic composition is in the form of a casting and has a duplex microstructure containing equiaxed and lamellar morphologies.

* * * * *